US006547981B2

(12) United States Patent
Messner et al.

(10) Patent No.: US 6,547,981 B2
(45) Date of Patent: Apr. 15, 2003

(54) PROCESS FOR TREATING ORGANIC FIBERS

(75) Inventors: Michael Messner, Semmelsberg (DE); Wolfgang Schattenmann, Burghausen (DE); Renate Minigshofer, Reut (DE); Evelyn Richter, Freising (DE)

(73) Assignee: Wacker-Chemie GmbH, Munich (DE)

( * ) Notice: Subject to any disclaimer, the term of this patent is extended or adjusted under 35 U.S.C. 154(b) by 0 days.

(21) Appl. No.: 10/106,662

(22) Filed: Mar. 26, 2002

(65) Prior Publication Data

US 2002/0175310 A1 Nov. 28, 2002

(30) Foreign Application Priority Data

Mar. 29, 2001 (DE) ..... 101 15 476

(51) Int. Cl.[7] ..... D06M 13/50

(52) U.S. Cl. ..... 252/8.61; 252/8.63; 252/8.81; 252/8.84; 252/8.85; 106/287.11; 427/387; 427/389.9

(58) Field of Search ..... 252/8.61, 8.63, 252/8.81, 8.84, 8.85, 8.86; 427/387, 389.9; 106/287.11

(56) References Cited

U.S. PATENT DOCUMENTS 4,388,437 A * 6/1983 Ona ..... 524/588
4,427,815 A * 1/1984 Ona et al. ..... 252/8.61
4,921,895 A 5/1990 Schaefer et al. ..... 524/379
5,562,761 A * 10/1996 Dirschl et al. ..... 252/8.62
5,612,438 A * 3/1997 Raleigh et al. ..... 528/26
6,201,058 B1 * 3/2001 Mahr et al. ..... 524/506
6,409,934 B1 * 6/2002 Naganawa et al. ..... 252/8.63

FOREIGN PATENT DOCUMENTS

| | | |
|---|---|---|
| DE | 196 52 524 A1 | 6/1998 |
| EP | 0 436 359 A2 | 7/1991 |
| EP | 0 577 039 A1 | 1/1994 |
| EP | 0636739 A1 * | 2/1995 |
| GB | 2 201 433 | 9/1988 |

OTHER PUBLICATIONS

English Derwent Abstract AN 1998–334390[30] Corresponding To DE 196 52 524 A1 (Jun. 1998).

H.J. Lautenschlager et al., "Struktur–Wirkungsbeziehung aminofunktioneller Siliconweichmachungsmittel," Textile Praxis International, vol. 47, No. 5, May 1, 1992, pp. 460–461.

* cited by examiner

*Primary Examiner*—Anthony Green
(74) *Attorney, Agent, or Firm*—Brooks & Kushman P.C.

(57) ABSTRACT

Organic fibers are treated with aqueous preparations comprising amino-functional organosilicon compounds of the general formula $$H_2N—R^1—SiR_2O(SiR_2O)_iSiR_2—R^1—NH_2$$

where i is an integer from 1 to 1000,

R is an identical or different monovalent hydrocarbon radical having 1 to 18 carbon atoms per radical, and $R^1$ is a divalent hydrocarbon radical having 2 to 10 carbon atoms. The treated organic fibers, particularly in the form of textiles, exhibit a soft hand and good rewettability.

7 Claims, No Drawings

PROCESS FOR TREATING ORGANIC FIBERS

BACKGROUND OF THE INVENTION

1. Field of the Invention

This invention relates to a process for treating organic fibers with amino-functional organosilicon compounds.

2. Background Art

Siloxanes bearing ammonium groups are well known from the literature, and may be prepared in various ways. One synthetic route, as described in GB-A 2 201 433 for example, starts with epoxy-functional silicones, which are obtained by a hydrosilylation of Si-H-bearing siloxanes with a vinyl-bearing epoxide, i.e. (allyl glycidyl ether) and reacts these epoxy-functional silicones with ammonium salts of tertiary amines to form silicones bearing ammonium groups. A further possibility comprises first preparing an aminoalkyl-bearing siloxane and then quaternizing it with alkylating agents, as described in EP-A 436 359.

Aminosiloxanes used as softeners in textile finishing overwhelmingly bear aminoethylaminopropyl or aminopropyl pendant groups. These pendant groups, which are cationic in neutralized form, become aligned on the fiber surface and hence cause the siloxane to become oriented on the fiber surface. This leads to an extremely soft and pleasant hand for textile substrates treated therewith. Aminosiloxanes are customarily applied in the form of emulsions. This constitutes the last operation in the production of textile fabrics and can be accomplished by so-called forced application, for example in a pad-mangle, or else in principle by exhaustion, owing to the cationic character of the aminosiloxanes.

A significant disadvantage of aminosiloxanes used today in textile finishing is the drastically impaired rewettability of textile substrate finished therewith. Rewettability is especially troublesome in the textile finishing field insofar as textile material, once finished, can no longer be crossdyed. This is important in particular because silicones, owing to their low refractive index, have a strongly color-deepening effect which can lead to hue shifts. Similarly, in the case of off-shade dyeings, poor rewettability of fabric treated with silicone softeners is detrimental because correcting the shade is virtually impossible. In addition, there are articles among consumer textiles which, although a "fuzzy" soft hand is desired, must be rewettable, for example terry toweling, underwear, etc. Similar requirements apply to treated nonwovens used, for example, in skin care. These articles must likewise have a soft hand without impairing absorbency.

SUMMARY OF THE INVENTION

It is an object of the present invention to provide a process for treating organic fibers with amino-functional organosilicon compounds which confer a soft hand and good rewettability without adverse effect on the thermal yellowing of the treated organic fibers and textile materials containing them.

DETAILED DESCRIPTION OF THE PREFERRED EMBODIMENT(S)

This object is achieved by the process for treating organic fibers with aqueous preparations comprising amino-functional organosilicon compounds of the general formula $$H_2N—R^1—SiR_2O(SiR_2O)_iSiR_2—R^1—NH_2$$

where i is an integer from 1 to 1,000, preferably 20 to 650,

R is an identical or different monovalent hydrocarbon radical having 1 to 18 carbon atoms per radical, and $R^1$ is a divalent hydrocarbon radical having 2 to 10 carbon atoms.

The organosilicon compounds of the invention are preferably linear diorganopolysiloxanes having terminal SiC-attached amino groups. The viscosity of the organosilicon compounds is preferably in the range from 30 to 10,000 mPa·s at 25° C., more preferably in the range from 30 to 5,000 mPa·s at 25° C., and the amine number is preferably in the range from 1.35 to 0.035 mmol/g and more preferably in the range from 1.35 to 0.042 mmol/g.

Examples of R radicals are alkyl radicals, such as the methyl, ethyl, n-propyl, isopropyl, 1-n-butyl, 2-n-butyl, isobutyl, tert-butyl, n-pentyl, isopentyl, neopentyl, and tert-pentyl radicals, hexyl radicals such as the n-hexyl radical, heptyl radicals such as the n-heptyl radical, octyl radicals such as the n-octyl radical and isooctyl radicals such as the 2,2,4-trimethylpentyl radicals, nonyl radicals such as the n-nonyl radical, decyl radicals such as n-decyl radical, dodecyl radicals such as n-dodecyl radical, and octadecyl radicals such as the n-octadecyl radical; cycloalkyl radicals such as the cyclopentyl, cyclohexyl, cycloheptyl and methylcyclohexyl radicals; aryl radicals such as the phenyl, naphthyl, anthryl and phenanthryl radicals; alkaryl radicals such as o-, m-, p-tolyl, xylyl and ethylphenyl radicals; and aralkyl radicals such as the benzyl, α-phenylethyl and β-phenylethyl radicals. R is preferably an alkyl radical having 1 to 6 carbon atoms per radical, preferably methyl.

Examples of $R^1$ are ethylene, n-propylene, isopropylene, n-butylene, cyclohexylene, phenylene and butenylene. $R^1$ is preferably an alkylene radical, preferably an alkylene radical of 3 or 4 carbon atoms, most preferably n-propylene.

The amino-functional organosilicon compounds of the invention may be prepared, for example, by a two stage process. The first stage of the process comprises reacting a short-chain dialkylpolysiloxane which bears a reactive Si—H group on both end groups with N,N-bis (trimethylsilyl)allylamine in the presence of a hydrosilylation catalyst. In the second stage, the α,ω-aminoalkylenediorganopolysiloxane thus obtained is coequilibrated with cyclic methylsiloxanes under basic catalysis.

The aqueous preparations of the invention are preferably in the form of an aqueous emulsion or an aqueous solution. The aqueous emulsions preferably comprise the amino-functional organosilicon compound of the invention, optionally an emulsifier, acid, and water.

The aqueous emulsions can be prepared by generally known processes. The preparation of the emulsions can be effected in customary mixing apparatus suitable for preparing emulsions, such as high-speed stator-rotor stirrers after Professor P. Willems of the kind known under the registered trademark "Ultra-Turrax". The organosilicon compounds of the invention can be emulsified using prior art processes such as shearing or phase inversion emulsification or by heating.

The aqueous emulsions preferably contain emulsifiers known per se.

Examples of anionic emulsifiers are:

1. Alkyl sulfates, particularly those having a chain length of 8 to 18 carbon atoms, alkyl and alkaryl ether sulfates having 8 to 18 carbon atoms in the hydrophobic radical and 1 to 40 ethylene oxide (EO) or propylene oxide (PO) units.

2. Sulfonates, particularly alkylsulfonates of 8 to 18 carbon atoms, alkylarylsulfonates of 8 to 18 carbon atoms, taurides, esters and monoesters of sulfosuccinic acid wit h monohydric alcohols or alkylphenols of 4 to 15 carbon atoms; optionally these alcohols or alkylphenols can also be ethoxylated with 1 to 40 EO units.

3. Alkali metal and ammonium salts of carboxylic acids having 8 to 20 carbon atoms in the alkyl, aryl, alkaryl or aralkyl radical.

4. Phosphoric acid partial esters and their alkali metal and ammonium salts, particularly alkyl and alkaryl phosphates having 8 to 20 carbon atoms in the organic radical, alkyl ether and alkaryl ether phosphates having 8 to 20 carbon atoms in the alkyl or alkaryl radical respectively and 1 to 40 EO units.

Examples of nonionic emulsifiers are:

5. Polyvinyl alcohol still having 5% to 50% and preferably 8% to 20% of vinyl acetate units and a degree of polymerization of 500 to 3,000.

6. Alkyl polyglycol ethers, preferably those having 6 to 40 EO units and alkyl radicals of 8 to 20 carbon atoms.

7. Alkylaryl polyglycol ethers, preferably those having 8 to 40 EO units and 8 to 20 carbon atoms in the alkyl and aryl radicals.

8. Ethylene oxide/propylene oxide (EO/PO) block copolymers, preferably those having 8 to 40 EO or PO units.

9. Addition products of alkylamines having alkyl radicals of 8 to 22 carbon atoms with ethylene oxide or propylene oxide.

10. Fatty acids of 6 to 24 carbon atoms.

11. Alkylpolyglycosides of the general formula R*—O—$Z_o$, where R* is a linear or branched, saturated or unsaturated alkyl radical having on average 8 to 24 carbon atoms and $Z_o$ is an oligoglycoside radical having on average o=1 to 10 hexose or pentose units or mixtures thereof.

12. Natural materials and derivatives thereof, such as lecithin, lanolin, saponins, cellulose; cellulose alkyl ethers and carboxyalkylcelluloses whose alkyl groups each have up to 4 carbon atoms.

13. Linear organo(poly)siloxanes containing polar groups, especially those having alkoxy groups having up to 24 carbon atoms and/or up to 40 EO and/or PO groups.

Examples of cationic emulsifiers are:

14. Salts of primary, secondary and tertiary fatty amines of 8 to 24 carbon atoms with acetic acid, sulfuric acid, hydrochloric acid and phosphoric acids.

15. Quaternary alkyl- and alkylbenzeneammonium salts, especially those whose alkyl groups possess 6 to 24 carbon atoms, especially the halides, sulfates, phosphates and acetates.

16. Alkylpyridinium, alkylimidazolinium and alkyloxazolinium salts, especially those whose alkyl chain possesses up to 18 carbon atoms, specifically the halides, sulfates, phosphates and acetates.

Examples of ampholytic emulsifiers are:

17. Amino acids having long-chain substituents, such as N-alkyl-di(aminoethyl)glycine or N-alkyl-2-aminopropionic acid salts.

18. Betaines, such as N-(3-acylamidopropyl)-N,N-dimethylammonium salts having a $C_8$–$C_{18}$-acyl radical and alkylimidazolium-betaines.

Preferred emulsifiers are nonionic emulsifiers, especially the alkyl polyglycol ethers recited above under 6., the addition products of alkylamine and ethylene oxide or propylene oxide recited under 9., the alkylpolyglycosides recited under 11. and the polyvinyl alcohol recited under 5.

The aqueous emulsion contains emulsifiers preferably in amounts of 0% to 15% by weight and more preferably 1% to 10% by weight, each percentage being based on the total weight of the emulsion.

The nitrogen atoms in the terminal amino groups of the organosilicon compounds according to the invention can be wholly or partly protonated by addition of an acid. Organic or inorganic acids or mixtures thereof can be used.

Examples of organic acids are monocarboxylic acids such as formic acid, acetic acid, propionic acid, butyric acid, pivalic acid, sorbic acid, benzoic acid, salicylic acid, and toluylic acid, and dicarboxylic acids such as succinic acid, maleic acid, adipic acid, malonic acid and phthalic acid, preference being given to monocarboxylic acids, with particular preference being given to formic acid, acetic acid and propionic acid.

Further examples of acids are sulfonic acids such as methanesulfonic acid, butanesulfonic acid, trifluoromethanesulfonic acid and toluenesulfonic acid, and also inorganic acids, such as hydrochloric acid, hydrobromic acid, sulfuric acid and phosphoric acid. The use of these strong acids is not preferred, however.

The acids are preferably used in amounts of 0.05% to 5% by weight and preferably of 0.05% to 1% by weight based on the total weight of the aqueous emulsion.

The aqueous emulsions preferably contain water in amounts of 20% to 95% by weight and more preferably 30% to 85% by weight based on the total weight of the aqueous emulsion, and preferably contain the amino-functional organosilicon compounds according to the invention in amounts of 5% to 70% by weight and more preferably in amounts of 10% to 50% by weight, the percentages being based on the total weight of the aqueous emulsion.

The aqueous emulsions can be further stabilized using nonaqueous but water-compatible solvents such as isopropanol, diethylene glycol monomethyl ether, diethylene glycol monobutyl ether, dipropylene glycol or dipropylene glycol monomethyl ether.

The subject process for treating, i.e. impregnating, organic fibers is useful with all organic fibers, for example in the form of filaments, yarns or as textile sheet materials such as webs, mats, strands, woven, loop-formingly knitted or loop-drawingly knitted textiles, as have hitherto been treatable with organosilicon compounds. Examples of fibers which can be treated by the process according to the invention are fibers composed of keratin, especially wool, polyvinyl alcohol, interpolymers of vinyl acetate, cotton, rayon, hemp, natural silk, polypropylene, polyethylene, polyester, polyurethane, polyamide, cellulose, and blends of at least two such fibers. As is clear from the preceding enumeration, the fibers can be of any natural or synthetic origin. The textiles or textile sheet materials can be present in the form of fabric webs or garments or parts of garments.

Application to the organic fibers to be treated can be effected in any manner known to be suitable for treating organic fibers, for example as mentioned at the outset.

The process of the invention has the advantage that organic fibers treated with the organosilicon compounds according to the invention possess soft hand and also good rewettability and that they are free of any thermal yellowing.

EXAMPLE 1

108.4 g of N,N-bis(trimethylsilyl)allylamine are initially charged to a 11 three-neck flask equipped with stirrer, reflux condenser and thermometer and are heated to reflux. 0.015 g of platinum (in the form of hexachloroplatinic acid) is then added, followed by the metered addition over 15 minutes of 389 g of an α,ω-SiH-containing polysiloxane (0.18% by weight of Si-attached hydrogen). The reaction temperature is adjusted to 150° C., followed by 30 minutes of refluxing. The reaction mixture is cooled to 75° C., followed by the addition of 50 g of ethanol. After a further 30 minutes of refluxing, a distillation is carried out at 130° C. and full-on vacuum. The yellow oil obtained has an amine number of 1.65 mmol/g and a viscosity of 19.3 $mm^2/s$ at 25° C.

EXAMPLE 2

6.1 g of the product obtained in example 1 are mixed with 193.0 g of octamethyltetrasiloxane and also 0.2 g of a 40% aqueous solution of tetrabutylphosphonium hydroxide in a 250 ml three-neck flask equipped with stirrer, reflux condenser and thermometer and the mixture is stirred at 100° C. for four hours. Subsequently the now distinctly viscous oil is admixed with a further 0.1 g of the 40% aqueous tetrabutylphosphonium hydroxide solution and the batch is subsequently stirred for a further two hours. This affords a clear colorless oil having a viscosity of 883 mPa·s at 25° C. and an amine number of 0.06 mmol/g.

EXAMPLE 3

12.1 g of the product obtained in example 1 are mixed with 187.9 g of octamethyltetrasiloxane and also 0.2 g of a 40% aqueous solution of tetrabutylphosphonium hydroxide in a 250 ml three-neck flask equipped with stirrer, reflux condenser and thermometer and the mixture is stirred at 100° C. for four hours. Subsequently the now distinctly viscous oil is admixed with a further 0.1 g of the 40% aqueous tetrabutylphosphonium hydroxide solution and the batch is subsequently stirred for a further two hours. This affords a clear colorless oil having a viscosity of 612 mPa·s at 25° C. and an amine number of 0.11 mmol/g.

EXAMPLE 4

24.2 g of the product obtained in example 1 are mixed with 175.8 g of octamethyltetrasiloxane and also 0.2 g of a 40% aqueous solution of tetrabutylphosphonium hydroxide in a 250 ml three-neck flask equipped with stirrer, reflux condenser and thermometer and the mixture is stirred at 100° C. for four hours. Subsequently the now distinctly viscous oil is admixed with a further 0.1 g of the 40% aqueous tetrabutylphosphonium hydroxide solution and the batch is subsequently stirred for a further two hours. This affords a clear colorless oil having a viscosity of 180 mPa·s at 25° C. and an amine number of 0.24 mmol/g.

EXAMPLE 5

36.4 g of the product obtained in example 1 are mixed with 163.6 g of octamethyltetrasiloxane and also 0.2 g of a 40% aqueous solution of tetrabutylphosphonium hydroxide in a 250 ml three-neck flask equipped with stirrer, reflux condenser and thermometer and the mixture is stirred at 100° C. for four hours. Subsequently the now distinctly viscous oil is admixed with a further 0.1 g of the 40% aqueous tetrabutylphosphonium hydroxide solution and the batch is subsequently stirred for a further two hours. This affords a clear colorless oil having a viscosity of 132 mPa·s at 25° C. and an amine number of 0.48 mmol/g.

EXAMPLE 6 (emulsification)

15 g of the aminosiloxane of example 2 are stirred with 5 g of an isotridecylethoxypolyethylene glycol having on average six ethylene oxide units, 5 g of an isotridecylethoxypolyethylene glycol having on average eight ethylene oxide units, 1 g of glacial acetic acid and 15 g of isopropanol until homogeneous. 59 g of water in total are then added to the mixture a little at a time with stirring. This provides a white emulsion.

EXAMPLE 7

The aminosiloxane obtained in example 3 was emulsified as per example 6 to provide a bluish transparent emulsion.

EXAMPLE 8

The aminosiloxane obtained in example 4 was emulsified as per example 6 to provide a bluish transparent emulsion.

EXAMPLE 9

The aminosiloxane obtained in example 5 was emulsified as per example 6 to provide a clear emulsion.

Comparative Example C1

A commercially available dimethylpolysiloxane having terminal methoxy groups and pendant aminoethylaminopropyl groups and having a viscosity of 987 mPa·s at 25° C. and an amine number of 0.3 mmol/g was emulsified as per example 6 to provide a clear emulsion.

Comparative Example C2

A commercially available dimethylpolysiloxane having terminal methoxy groups and pendant aminoethylaminopropyl groups and having a viscosity of 987 mPa·s at 25° C. and an amine number of 0.6 mmol/g was emulsified as per example 6 to provide a clear emulsion.

Finishing Examples: Padding

EXAMPLES 10 TO 16

A bleached, unfinished 400 g/m$^2$ cotton terry toweling fabric was used for the determinations of soft hand, water absorption time (hydrophilicity) and whiteness. The fabric was saturated with each liquor, squeezed off to 80% wet pick-up on a two-bowl pad-mangle and dried at 120° C. for 10 minutes. The finished fabric was then conditioned at 23° C. and a relative humidity of 50% for eight hours.

The table which follows shows the products used for examples 10 to 16 and the results for the pad-finished fabric.

Example 16 in the table is a blank in that it was performed with water (hydrophilic, no yellowing but no soft hand either).

TABLE

| Example | 10 | 11 | 12 | 13 | 14 | 15 | 16 |
|---|---|---|---|---|---|---|---|
| Emulsion of Ex. 6 | | | 20 g/l | | | | |
| Emulsion of Ex. 7 | | | | 20 g/l | | | |
| Emulsion of Ex. 8 | | | | | 20 g/l | | |
| Emulsion of Ex. 9 | | | | | | 20 g/l | |
| Emulsion of Comp. Ex. C1 | | 20 g/l | | | | | |

TABLE-continued

| Example | 10 | 11 | 12 | 13 | 14 | 15 | 16 |
|---|---|---|---|---|---|---|---|
| Emulsion of Comp. Ex. C2 | 20 g/l | | | | | | |
| Glacial acetic acid | 0.5 g/l | 0.5 g/l | 0.5 g/l | 0.5 g/l | 0.5 g/l | 0.5 g/l | 0.5 g/l |
| Thermal yellowing after 2'@170° C. | 191 | 187 | 199 | 197 | 195 | 192 | 199 |
| Droplet absorption time in seconds | 30 | 77 | 3 | 2 | 6 | 3 | 1 |
| Hand | 5.5 | 5.3 | 5.5 | 5 | 3.2 | 2.5 | 1 |

Determination of Soft Hand (Hand Assessment)

Since the soft hand of textiles is greatly dependent on the subjective feel of the tester, only the boundary conditions can be standardized and not the assessment itself. To ensure reproducibility nonetheless, the finished samples were ranked in order with regard to their soft hand. To this end, 10 testers awarded 1 to n points to n samples, n points being awarded to the softest sample and 1 point to the least soft sample. The tables report the average values of points scored by each sample.

Determination of Water Absorption Time (Hydrophilicity)

After finishing, the finished sample was conditioned at 23° C. and a relative humidity of 50% for eight hours before a drop of deionized water was placed on the fabric surface and the time was taken for the droplet of water to be adsorbed by the fabric, three minutes being the longest time allowed. Five determinations were carried out and the results averaged.

Determination of Thermal Yellowing (Whiteness)

The dry fabric, pad-treated as per the finishing examples was supplementarily cured at 170° C. for a further two minutes. The fabric thus treated was conditioned at 23° C. and a relative humidity of 50% for eight hours. The Ganz whiteness was then determined as per the publication "E. Ganz, Whiteness: Photometric specifications and calorimetric evaluation, Appl. Opt. 15 (1976), pages 2039–2058".

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. In the claims, the terms "a" and "an" mean "one or more" unless indicated to the contrary.

What is claimed is:

1. A process for treating organic fibers with aqueous preparations, comprising treating said organic fibers with an aqueous composition comprising at least one amino-functional organosilicon compound of the general formula $$H_2N—R^1—SiR_2O(SiR_2O)_iSiR_2—R^1—NH_2$$

where i is an integer from 1 to 1000,

R is an identical or different monovalent hydrocarbon radical having 1 to 18 carbon atoms per radical, and $R^1$ is a divalent hydrocarbon radical having 2 to 10 carbon atoms.

2. The process of claim 1, wherein $R^1$ is n-propylene.

3. The process of claim 1, wherein the aqueous preparations used are aqueous emulsions.

4. The process of claim 2, wherein the aqueous preparations used are aqueous emulsions.

5. The process of claim 3, wherein the aqueous emulsion further comprises an emulsifier, an acid, or both an emulsifier and an acid.

6. The process of claim 4, wherein the aqueous emulsion further comprises an emulsifier, an acid, or both an emulsifier and an acid.

7. The process of claim 1, wherein the organic fibers comprise textile fabrics.

* * * * *

UNITED STATES PATENT AND TRADEMARK OFFICE

CERTIFICATE OF CORRECTION

PATENT NO. : 6,547,981 B2
DATED : April 15, 2003
INVENTOR(S) : Michael Messner et al.

It is certified that error appears in the above-identified patent and that said Letters Patent is hereby corrected as shown below:

Title page,
Item [73], Assignee, should also include, along with "Wacker-Chemie GmbH", the following Assignee:

-- Kelmar Industries, Inc.
310 Spartangreen Blvd.
Duncan, South Carolina 29334 --

Signed and Sealed this

Fourteenth Day of December, 2004

JON W. DUDAS
*Director of the United States Patent and Trademark Office*